United States Patent [19]

Cayley

[11] 4,117,309

[45] Sep. 26, 1978

[54] ELECTRIC TOWEL WARMER

[76] Inventor: Michael Paul Cayley, 94 Watergate, S. Barrington, Ill. 60010

[21] Appl. No.: 708,572

[22] Filed: Jul. 26, 1976

[51] Int. Cl.[2] ..... H05B 1/00; H05B 3/02; F26B 9/00; F26B 25/06

[52] U.S. Cl. ..... 219/385; 34/151; 34/202; 34/239; 219/218; 219/342; 219/521

[58] Field of Search ..... 219/342, 345, 359, 521, 219/366-368, 385, 374-376, 377, 520, 385, 386, 218; 34/239, 243 R, 201, 202, 240, 148, 151

[56] References Cited

U.S. PATENT DOCUMENTS

| | | | |
|---|---|---|---|
| 1,079,225 | 11/1913 | Dubilier | 219/342 |
| 1,288,046 | 12/1918 | Kuhn et al. | 219/342 |
| 1,620,537 | 3/1927 | Garey | 219/359 |
| 1,914,190 | 6/1933 | Herr | 34/239 |
| 1,919,081 | 7/1933 | Weisswasser | 34/202 |
| 2,473,783 | 6/1949 | Brown | 219/368 |
| 2,690,496 | 9/1954 | Soprano | 219/521 X |
| 2,815,585 | 12/1957 | Thompson | 34/239 X |
| 3,038,058 | 6/1962 | Gordon | 219/521 X |
| 3,626,152 | 12/1971 | Governale | 219/521 X |
| 3,849,629 | 11/1974 | Graham | 219/521 X |

FOREIGN PATENT DOCUMENTS

| | | | |
|---|---|---|---|
| 870,055 | 12/1941 | France | 219/375 |
| 304,473 | 10/1959 | Switzerland | 34/201 |

*Primary Examiner*—A. Bartis
*Attorney, Agent, or Firm*—Thomas R. Vigil

[57] ABSTRACT

The electric towel warmer is constructed and arranged for receiving a towel therein and for maintaining the towel in a warm condition. The towel warmer includes a housing mounting an M-shaped heating element in the housing in a generally upright plane. A perforated cover is situated in the housing over the heating element and is spaced from the sidewalls of the housing to provide a space between the sidewalls of the housing and the cover for a towel. A movable top closure is mounted to the housing for covering the top of the housing. Electric circuitry is connected to the heating element and is adapted to be connected to an AC power source for controlling the current input to the heating element.

9 Claims, 4 Drawing Figures

ELECTRIC TOWEL WARMER

BACKGROUND OF THE INVENTION

1. Field of the Invention

The field of the invention is heaters for towels and more particularly an electric towel warmer.

2. Description of the Prior Art

The advantages of having a warm towel available when stepping from a warm shower or bath is well known. Such a warm towel offers greater comfort and in some countries it is quite common to find steam heated towel heaters or warmers in hotels and motels. Moreover, with hotels and motels competing with each other for business, such competition often revolves around the luxury items or services which a motel or hotel provides. In view of this competition for luxury items in hotels and motels, it has heretofore been proposed to provide an electric heater for towels which is particularly adapted for use in hotels or motels. Such a heater for towels is disclosed in U.S. Pat. No. 3,457,389.

The heater proposed in the patent referred to above includes horizontally disposed, spaced-apart plates, each of which has a heating element therein. Towels to be heated are placed between the plates and heated by the plates.

As will be described in greater detail hereinafter, the electric towel warmer of the present invention differs from this prior art electric heater for towels by providing a generally upright towel warmer having an electric heating element disposed in a substantially upright plane and a cover therefor which is sized and arranged to fit about the heating element in a generally upright position for supporting a towel draped thereover. In this way, the towel is heated from the inside out rather than the outside in. This construction and arrangement has the advantage of conserving heat, as well as electric power for generating the same since the towel supported on the cover surrounding the heating element serves as an insulator and serves to confine the generated heat within the area enclosed by the towel.

SUMMARY OF THE INVENTION

According to the invention there is provided an electric towel warmer of the type having a heating element adjacent to which a towel is placed for warming the towel. A cover is provided for the heating element and the heating element is connected in circuit with control circuitry for controlling the electric current to the heating element. The heating element is configured and arranged to be in a generally upright plane and the cover for said heating element has openings therein to facilitate heat transfer by convection, conduction, and radiation from the heating element through the cover to the towel. The cover is sized and arranged to fit over the heating element in spaced relationship thereto in a generally upright position for supporting a towel draped thereover. The towel warmer further includes a housing completely surrounding the heating element and the cover for the heating element. The housing includes spaced apart end walls and sidewalls, an open bottom, and an openable top closure with the heating element being mounted on a base within the housing with the base closing off the bottom of the housing. The cover for the heating element extends between the end walls and is situated between and spaced from the sidewalls such that a towel received in the housing through the openable top closure and draped over the cover has one portion situated between one sidewall and the cover, and another portion situated between the other sidewall and cover. The control circuitry for the towel warmer includes means within the cover in circuit with the heating element for maintaining the temperature in the housing at a temperature adequate to warm a towel placed in the housing.

DESCRIPTION OF THE PREFERRED EMBODIMENT

Figure 1:
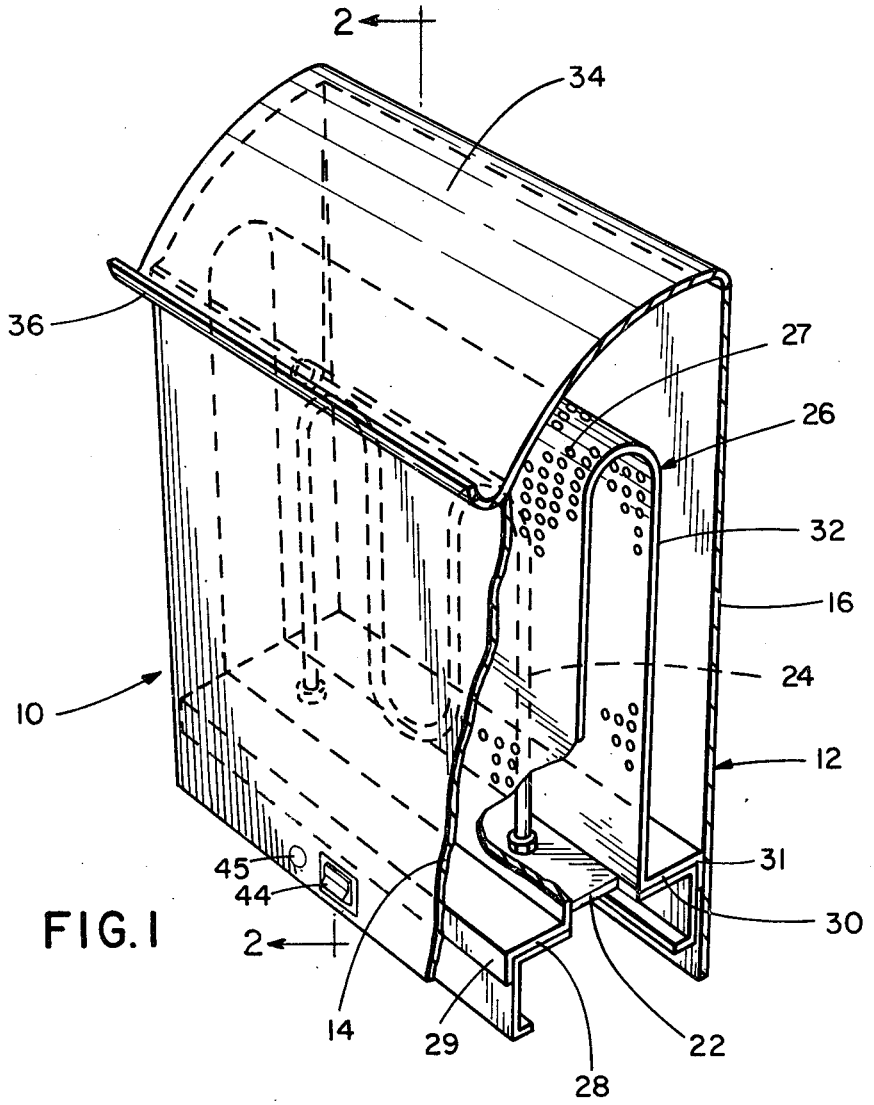
FIG. 1 is a perspective view of the electric towel warmer of the present invention with portions broken away and portions hidden from view shown in phantom lines.
Figure 3:
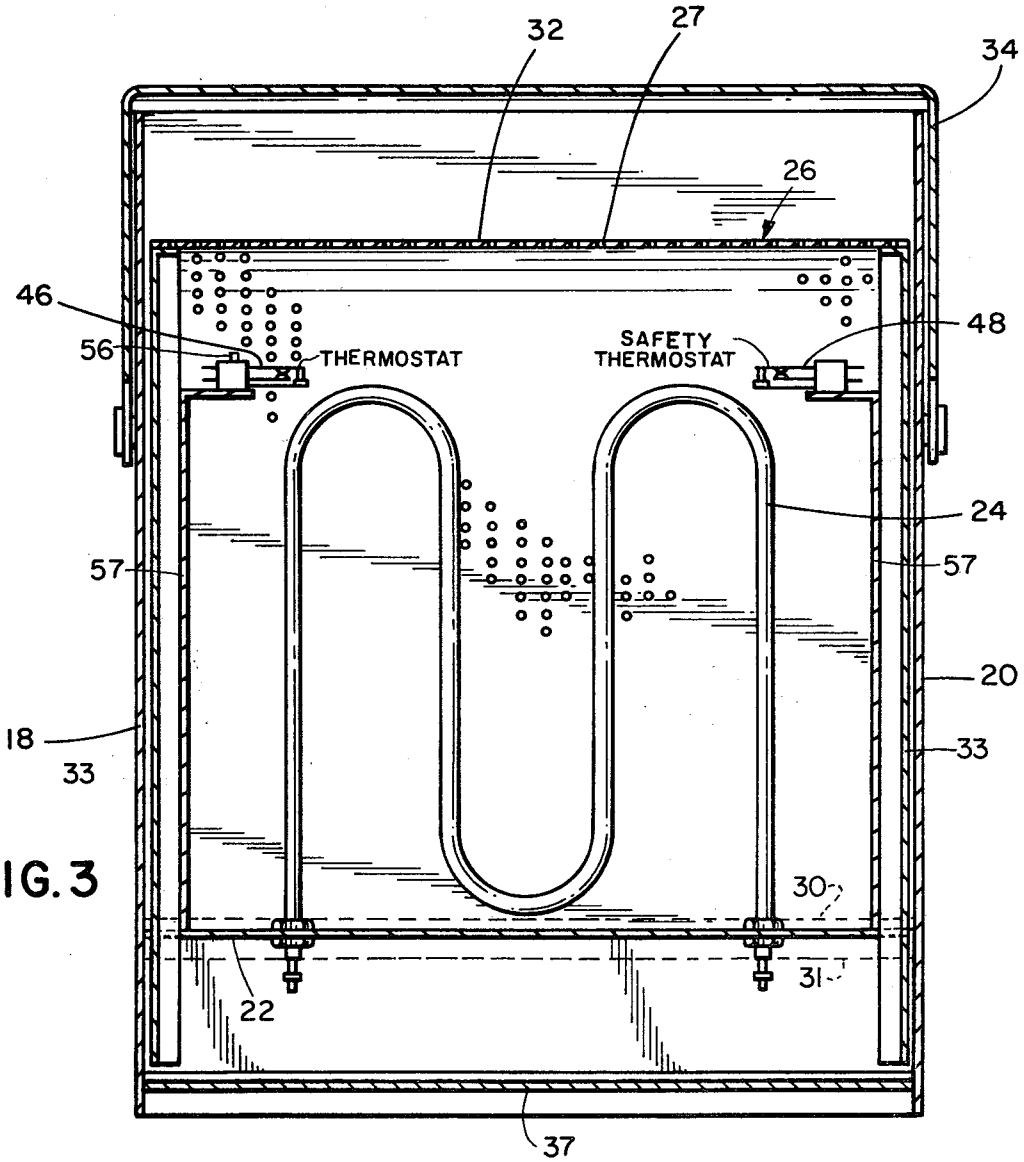
FIG. 3 is a sectional view of the towel warmer and is taken along line 3—3 of FIG. 2.

Referring now to the drawings in greater detail, an electric warmer constructed in accordance with the teachings of the present invention is shown in FIG. 1 and generally identified by the reference numeral 10. The towel warmer 10 includes a generally rectangular or box-shaped housing 12 including a front side wall 14, a back side wall 16 and end walls 18 and 20 (FIG. 3). As shown, a bottom frame member 22 having an inverted generally U-shaped cross section is fixed between the side walls 14 and 16.

Figure 2:
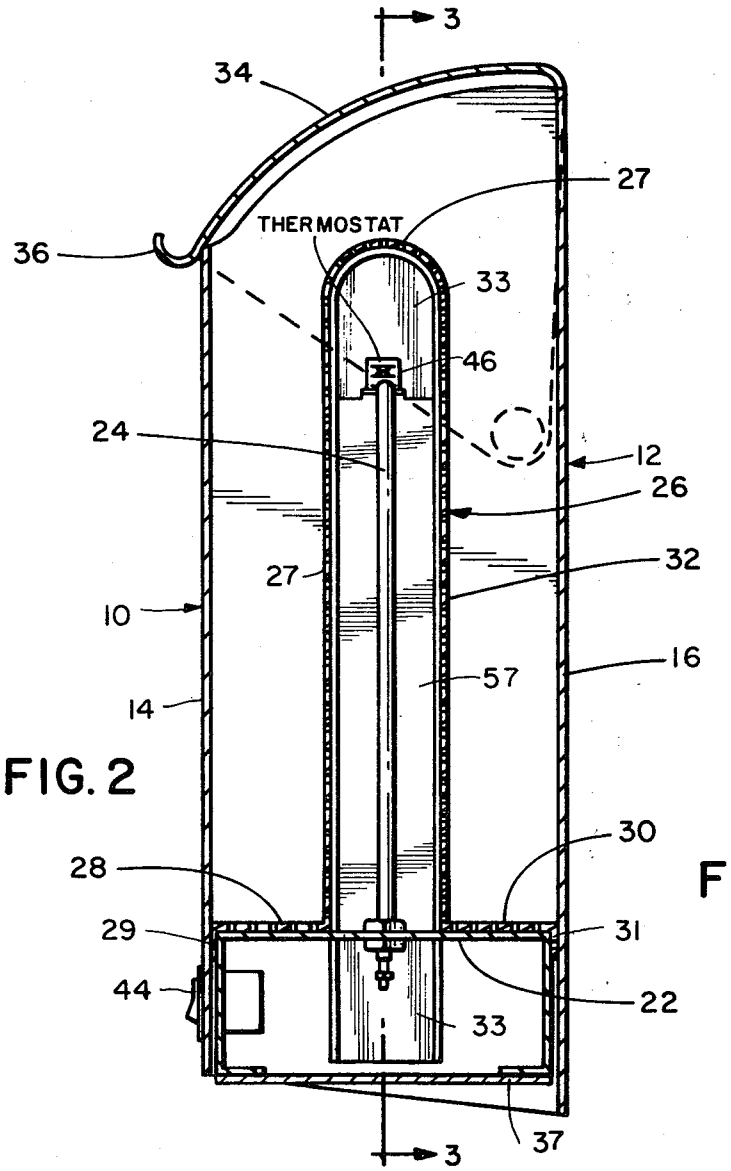
FIG. 2 is a sectional view of the electric towel warmer shown in FIG. 1 and is taken along line 2—2 of FIG. 1.

As best shown in FIGS. 2 and 3, an M-shaped heating element 24 is mounted on the frame member 22 and, according to the teachings of this invention, is disposed in a generally upright plane. Also in accordance with the teachings of the present invention, the towel warmer 10 includes a cover 26 for the heating element 24.

In one preferred embodiment, the cover 26 is formed from a sheet of perforated aluminum so as to have a plurality of openings 27 and includes a base portion having two sections 28 and 30 and depending flanges 29 and 31 which extend from either side of a generally upright portion 32 of the cover 26. If desired, and as shown in FIG. 3, the cover 26 can have upstanding end walls 33 telescopically received within the upper end portion 32 and extending downwardly below sections 28 and 30. The end walls 33 are omitted from FIG. 1.

As shown in FIG. 1, each of the sections 28 and 30 of the base portion has a flange 29 and 31 which is received between the bottom frame member 22 and one side wall 14 or 16 of the housing 12. In this way the frame member 22 not only serves as a support for the heating element 24, but also serves as a means for fixing the cover 26 in the position shown in FIGS. 1, 2 and 3.

The upright portion 32 of the cover 26 is generally U-shaped and is sized, configured and arranged to fit over, but spaced from, the heating element 24.

The housing 12 is open at the top and includes a movable closure or cover 34 which, in the illustrated embodiment and as best shown in FIG. 3, is pivotally mounted to the end walls 18 and 20. The cover 34 has a lip or flange formation 36 forming a handle or gripping means by which one can easily uncover the open top of the housing 12 for inserting a towel. Preferably a bottom plate 37 (omitted from FIG. 1) is secured to the underside of the frame member 22.

It will be readily apparent from the Figures that a towel is received into the housing 12 and is draped over the cover 26 with one portion of the towel being received between the front side wall 14 and the upright portion 32 of the cover 26 and another portion being received between the back side wall 16 and the upright portion 32 of the cover 26.

The openings 27 in the cover 26, and particularly in the upright portion 32 thereof, permit heating of the towel in several ways. First of all, the air that is heated within the space beneath the cover 26 by the heating element 24 is permitted to flow through the openings 27 and heat the towel by convection. Also, heat radiated from the heating element 24 and passing through the openings 27 heat the towel by radiation. In addition, heat radiated from the heating element 24 to the cover 26 is transmitted by conduction from the cover 26 to the towel draped thereover.

Figure 4:
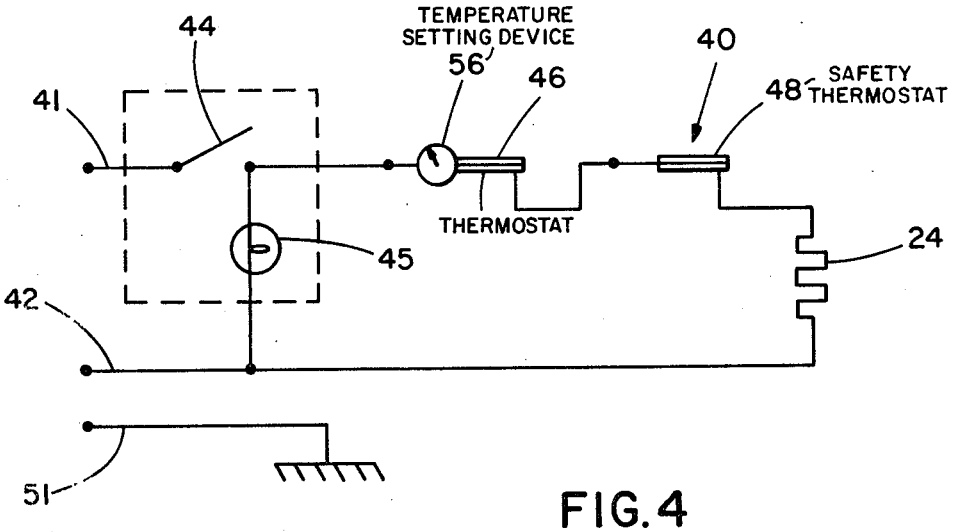
FIG. 4 is a schematic circuit diagram of the control circuitry for the electric towel warmer and is shown on the first sheet of drawings with FIG. 1.

Referring now to FIG. 4, the electric towel warmer of the present invention includes a control circuit generally identified by reference numeral 40. The control circuit 40 includes two input lines 41 and 42. An on-off switch 44 is situated in the input line 41. The lines 41 and 42 are connected to an on-off light 45, as well as to a thermostat 46, a temperature sensitive overload protector or safety thermostat 48 and the heating element 24, all three of which are connected in series and then connected in parallel with the on-off light 45. For safety purposes, the control circuit 40 also includes a third or ground wire 51.

The thermostat 46 is of the bi-metallic type and is provided with a well-known and conventional operating temperature setting device 56 for setting the temperature which thermostat 46 de-energizes heating element 24. The temperature sensitive overload protector 48 is also of the bi-metallic type as shown. The thermostat 46 and the overload protector 48 are disposed within the space between the heating element and the top of the upright portion 32 of the cover 26, as best shown in FIG. 3 and mounted on upstanding brackets 57 and 58 extending upwardly from member 22. More specifically, the thermostat 46 and the overload protector 48 are situated slightly above and adjacent either end of the heating element 24 as shown in FIG. 3. Preferably, the device 56, will be mounted within the cover 26 and the switch 44 and light 45 are mounted on the front of the wall 14 as indicated in FIG. 2. It will be noted that the thermostat 46, overload protector 48 and device 56 as well as mounting brackets 57 and 58 and end wall 33, are omitted from FIG. 1 to provide a clearer view of cover 26.

It has been determined empirically that a good workable temperature setting for the bi-metallic thermostat 46 is one which opens the circuit to the heating element 24 when the heating element 24 is at a temperature between 200° and 230° F. More specifically, one preferred temperature setting is 215° to 220° F. At such a circuit opening-circuit closing temperature setting, after the thermostat 46 has gone through several cycles of turning off and turning on the current to the heating element 24, the temperature just outside the cover 26 reaches a steady state temperature of approximately 200° F.

It will be apparent from the foregoing description that the electric towel warmer 10 of the present invention has a number of advantages, some of which have been described above and others of which are inherent in the invention. Specifically, the construction and arrangement of the parts of the warmer provide for quick and efficient heating or warming of a towel inserted therein. In this respect, the perforated cover 26 provides for heating by convection, conduction and radiation. Also, the cover 26 provides a support for a towel which is easily draped thereover. Moreover, the towel is heated from within and both the towel and the side walls 14 and 16 of the housing 12 confine the heat within the towel. Additionally, the towel warmer 10 can be easily mounted in a vertical position in a bathroom by fixing the back side wall 16 to a wall or vertical surface.

Also, it will be apparent from the foregoing description that obvious modifications and variations can be made to the towel warmer without departing from the scope of the invention as defined in the appended claims.

I claim:

1. In an electric towel warmer comprising a heating element adjacent to which a towel is placed for warming the same, means covering said heating element and control circuitry for controlling the electric current to the heating element, the improvement residing in the combination of: said heating element being configured and arranged to be in a generally upright plane, said cover means having openings therein to facilitate heat transfer by convection, conduction, and radiation from said heating element through said cover means and being sized and arranged to fit over said heating element in spaced relationship thereto in a generally upright position for supporting a towel draped thereover; said towel warmer including a housing completely surrounding said heating element and said cover means, said housing having spaced apart end walls and sidewalls, an open bottom and an openable top closure with said heating element being mounted on a base within said housing with said base closing off the bottom of said housing, said cover means extending between said end walls and being situated between and spaced from said sidewalls, such that a towel received in said housing through said openable top closure and draped over said cover means has one portion situated between one sidewall and said cover means and another portion situated between the other sidewall and said cover means, and said control circuitry including means within said cover means in circuit with said heating element for maintaining the temperature within said housing at a temperature adequate to warm a towel in said housing.

2. The towel warmer according to claim 1, wherein said cover means is perforated to form said opening.

3. The towel warmer according to claim 1, wherein said housing has an open top and said top closure is movably mounted to said housing and movable to and from a position covering said open top.

4. The towel warmer according to claim 1, wherein said cover means has a base portion fixed to and between said walls of said housing and said base and an upright portion having an inverted generally U-shaped cross-section, said upright portion being received over said heating element.

5. The towel warmer according to claim 1, wherein said heating element has a generally "M" shape.

6. The towel warmer according to claim 1, wherein said cover means is made from a sheet of perforated aluminum with the perforations thereof forming said openings.

7. The towel warmer according to claim 1, wherein said means within said cover in circuit with said heating element includes a thermostat connected in series with said heating element and having a temperature setting for opening and closing the circuit to said heating element which will maintain the temperature within said cover means between 200° F. and 280° F.

8. The towel warmer according to claim 7, wherein said temperature setting is between 200° F and 230° F.

9. The towel warmer according to claim 7, wherein said control circuitry further includes a temperature responsive onverload protector in series with said thermostat and said overload element and an on-off light connected in parallel with said thermostat, said overload protector said heating element, input lines to said parallel connection and an on-off switch in one of said lines.

* * * * *

UNITED STATES PATENT OFFICE
CERTIFICATE OF CORRECTION

PATENT NO. : 4,117,309
DATED : September 26, 1978
INVENTOR(S) : Michael Paul Cayley It is certified that error appears in the above-identified patent and that said Letters Patent are hereby corrected as shown below:

Column 6, line 5, "onverload" should be --overload--.

Column 6, line 6, "overload" should be --heating--.

Column 6, line 8, "protector said" should be --protector and said--.

Signed and Sealed this
*Sixteenth* Day of *January 1979*

[SEAL]

*Attest:*

RUTH C. MASON
*Attesting Officer*

DONALD W. BANNER
*Commissioner of Patents and Trademarks*